US006662732B2

(12) United States Patent
Birsel et al.

(10) Patent No.: US 6,662,732 B2
(45) Date of Patent: Dec. 16, 2003

(54) MODULAR DESK

(75) Inventors: Ayse Gul Birsel, New York, NY (US); Robert Warren Insalaco, Holland, MI (US); Ayako Takase, Brooklyn, NY (US)

(73) Assignee: Herman Miller, Inc., Zeeland, MI (US)

( * ) Notice: Subject to any disclaimer, the term of this patent is extended or adjusted under 35 U.S.C. 154(b) by 144 days.

(21) Appl. No.: 09/932,835

(22) Filed: Aug. 17, 2001

(65) Prior Publication Data

US 2002/0040667 A1 Apr. 11, 2002

Related U.S. Application Data

(60) Provisional application No. 60/226,068, filed on Aug. 17, 2000, and provisional application No. 60/240,526, filed on Oct. 13, 2000.

(51) Int. Cl.[7] ..... A47B 17/00

(52) U.S. Cl. ..... 108/25; 312/196; 312/209; 108/26

(58) Field of Search ..... 108/25, 26, 64, 108/901, 24, 27, 60, 61, 50.02; 312/194, 195, 196, 140.1, 140.2, 140.3, 140.4, 209, 228, 229

(56) References Cited

U.S. PATENT DOCUMENTS

| | | | | | |
|---|---|---|---|---|---|
| 107,015 | A | * | 9/1870 | Dodge | 108/25 |
| 658,983 | A | * | 10/1900 | Francis | 108/25 |
| 764,832 | A | * | 7/1904 | Valentine | 312/220 |
| 882,064 | A | | 3/1908 | Howlett | |
| 887,594 | A | * | 5/1908 | Daniel | 108/25 |
| 1,454,467 | A | * | 5/1923 | Crooks | 312/225 |
| 1,579,823 | A | * | 4/1926 | Langguth | 232/1 R |
| 1,906,213 | A | | 4/1933 | Neuschotz et al. | |
| 2,084,854 | A | * | 6/1937 | McCarthy | 108/31 |
| 2,497,278 | A | | 2/1950 | Soderlund | |
| 2,683,639 | A | * | 7/1954 | Brenny | 108/132 |
| 3,364,882 | A | * | 1/1968 | Merrick | 108/25 |
| 3,413,053 | A | | 11/1968 | Featherston | |
| 3,566,816 | A | | 3/1971 | Zilg | |
| 3,655,253 | A | | 4/1972 | Deeds et al. | |
| 4,177,737 | A | | 12/1979 | Brickman | |
| 4,427,391 | A | | 1/1984 | Berman | |
| 4,603,642 | A | | 8/1986 | Brickman | |

(List continued on next page.)

FOREIGN PATENT DOCUMENTS

| | | | |
|---|---|---|---|
| GB | 196741 | | 5/1923 |
| GB | 2286524 | * | 8/1995 |

OTHER PUBLICATIONS

Kiyohiro, Hayashi, Abstract for JP10283065A2: "Dead Space Improving Desk For Computer", issued Oct. 23, 1998.

U.S. Provisional Application entitled "Partitional Panel Insert Panel," filed Nov. 24, 1999, in the name of Ken Assink. 60/167,303.

*Primary Examiner*—Janet M. Wilkens
(74) *Attorney, Agent, or Firm*—Brinks Hofer Gilson & Lione

(57) ABSTRACT

In a preferred embodiment, a modular desk includes a frame defining a periphery of a worksurface area and at least one opening formed within the worksurface area. A storage accessory is removeably received in the opening and releaseably engages the frame. In one embodiment, the frame further comprises a plurality of sockets formed therein. An accessory includes a stanchion having an insert portion received in at least one of the plurality of sockets. In one embodiment, an accessory includes a flexible membrane, which forms at least a portion of a worksurface. A method of reconfiguring a worksurface with various accessories is also provided, as is a method for storing an article on a worksurface.

17 Claims, 8 Drawing Sheets

U.S. PATENT DOCUMENTS 4,645,878 A * 2/1987 Hilger et al. ..... 108/64 X
4,747,352 A 5/1988 Guidry et al.
4,972,781 A 11/1990 Montgomery et al.
5,055,081 A 10/1991 Nayak
5,060,580 A * 10/1991 Shaw ..... 108/25
5,085,153 A 2/1992 McKee
5,094,174 A 3/1992 Grund et al.
D332,188 S 1/1993 Brodbeck
5,218,912 A 6/1993 Buske
5,327,838 A 7/1994 Beltman
5,360,264 A * 11/1994 Crane ..... 312/293.1
5,460,102 A * 10/1995 Pasmanick ..... 108/43
5,535,682 A * 7/1996 Aigeldinger ..... 108/25
5,556,181 A 9/1996 Bertrand
5,564,345 A * 10/1996 Crawford et al. ..... 108/91
D377,378 S * 1/1997 Monneret ..... D21/121
5,672,130 A * 9/1997 O'Connell et al. ..... 473/483
5,673,632 A 10/1997 Sykes
5,740,743 A 4/1998 Schairbaum
5,766,017 A 6/1998 Nevin et al.
5,778,800 A 7/1998 Liang
5,823,642 A 10/1998 Korolainen
5,878,672 A 3/1999 Ostermann et al.
6,012,788 A 1/2000 Marschand et al.

* cited by examiner

MODULAR DESK

This application claims the benefit of U.S. Provisional Application Ser. No. 60/226,068, filed Aug. 17, 2000, and U.S. Provisional Application Ser. No. 60/240,526, filed Oct. 13, 2000, the entire disclosures of which are hereby incorporated herein by reference.

BACKGROUND

The present invention relates generally to desks and worksurfaces, and in particular, to a modular desk having removable accessories and a worksurface comprising a flexible membrane, and to methods for uses thereof.

Desks of the type typically used in offices and the like are typically configured with a homogenous worksurface member made of a rigid material having a non-resilient surface. Such worksurface members provide the user with an appropriate surface for writing and the like and are capable of supporting various pieces of office equipment such as telephones and personal computers, which typically are randomly located thereon and which occupy otherwise usable space. Typically, if configured with storage, the desks will have one or more shelves or laterally moveable drawers arranged vertically in series below the worksurface. Such drawers typically are rigid so as to support a cantilevered load as they are moved laterally outward away from a support structure. Alternatively, the user may be provided with separate storage in the form of file cabinets or pedestals, also typically arranged for access below the worksurface of the desk. Likewise, waste receptacles are typically free-standing devices placed beneath a worksurface, or adjacent to a desk.

Conventional storage accessed beneath the worksurface can often be limited in height and is typically accessed by pulling the drawer laterally outward, which can interfere with the user's mobility and requires a larger footprint for the overall workspace.

Moreover, conventional worksurfaces, which are typically non-resilient, can be unforgiving when used to store various relatively fragile articles such as eyeglasses, ceramic mugs and the like, thereby leading to the inadvertent breakage of such items.

SUMMARY

Briefly stated, in one aspect, one embodiment of the invention is directed to a modular desk comprising a frame having an upper surface and defining a periphery of a worksurface area. The frame defines at least one opening formed within the worksurface area. A storage accessory is removeably received in the at least one opening, wherein it engages the frame.

In a preferred embodiment, the frame divides the worksurface area into opposite side regions and a middle region positioned therebetween, with each of the opposite side regions having an opening formed therein. Preferably, a worksurface member is supported by the frame in the middle region. Also in a preferred embodiment, a cover is disposed over the storage accessory. The cover preferably has a worksurface. In an alternative preferred embodiment, a worksurface member is disposed over the openings formed in the opposite side regions. Preferably, the worksurface member has a first and second side, each of which is configured with varying indicia or colors, such that the worksuface member can be flipped to present a different aesthetic.

Preferably, the frame has a plurality of openings. A plurality of storage accessories is removeably received in the openings. In one embodiment, the various storage accessories are provided in different colors.

In another aspect, one embodiment of the frame includes a plurality of sockets formed therein, and preferably formed around a periphery of the worksurface area. A second storage accessory comprises a stanchion comprising an insert portion received in at least one of the sockets.

In yet another aspect, one embodiment of the worksurface member comprises an exposed, flexible portion defining at least a portion of a worksurface area defined by a worksurface member. Preferably, the worksurface member further comprises a non-flexible surface forming at least a portion of the worksurface area. In a preferred embodiment, the flexible portion comprises a stretched membrane that is removeably disposed on said worksurface member.

In another aspect, a method for reconfiguring a worksurface is provided. The method comprises removing a first accessory from the opening in the worksurface member and inserting a second accessory in the opening. In another aspect, a method for storing an article on a worksurface is provided. The method comprises disposing an article on a flexible portion of said worksurface member, and flexing said membrane in response thereto.

In yet another aspect, the accessory comprises a mat of compressed fibers. The mat is preferably tackable and can be made in a variety of different colors.

The present invention provides significant advantages over other desks and worksurfaces. For example, the storage accessories can be accessed from the top of the worksurface, rather from beneath the worksurface or by laterally moving the storage unit. In such a configuration, the storage accessory can be made relatively deep so as to accommodate oversize objects. In addition, such access and orientation lends itself to the storage of various randomly stacked or deposited items, such as waste products. Alternatively, the storage accessory can serve to hold various food articles and beverage items. Since the storage accessories are preferably removeable, they can be easily, vertically removed, emptied and cleaned without the use of expensive and complicated slide mechanisms and the like.

Since the storage accessory does not necessarily have to be rigid, due to its support structure and orientation, it can be made of flexible materials, such as woven fabrics or netting, which are typically less expensive than conventional drawers. In addition, the modular desk, with its openings, allows for the workspace to be reconfigured to suit the user's individual needs. In this way, a variety of storage accessories can be made available to accommodate the various goods being stored therein. In addition, the storage accessories can be made of different colors to suit the individual aesthetic needs of the user, as well as to allow the user to organize the workspace, for example by providing a certain color that corresponds to a particular type of accessory or article stored therein. In addition, with the accessories preferably supported at the side regions of the worksurface area, the accessories do not interfere with the user's knees and legs as they are positioned by the user beneath the desk.

The worksurface member, with its sockets and stanchion supported accessories, also provides an ideal storage vehicle above the worksurface. In particular, the storage accessory can be elevated above the worksurface to clear more space for the user on the worksurface. At the same time, the various storage accessories allow the user to easily access necessary and important office equipment such as a telephone or computer.

The flexible portion of the worksurface also provides several advantages. In particular, the flexible portion provides an ideal location to store various fragile articles, such as eye glasses. The flexible portion cushions the landing of such objects, when tossed thereon, and also flexes in response to heavier objects inadvertently falling on such objects that are located on the flexible portion, so as to protect them from damage.

The construction of the compressed fiber accessories also provides several advantages. In particular, the accessories can be made different colors without the need to attach a separate fabric covering, or outer fascia layer. Moreover, the accessories can be made with less expense than conventional molded plastic articles, and are lighter and easier to ship. At the same time, the compressed fiber provides an ideal tackable surface allowing the user to post various important papers and the like thereon.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

The terms "front", "side", "back", "forwardly", "rearwardly", "upwardly" and "downwardly" as used herein are intended to indicate the various directions and portions of the desk as normally understood when viewed from the perspective of a user facing the desk. Likewise, the term "lateral" refers to the direction running the length of the desk from one side to the other, while the term "longitudinal" refers to the direction running from the front to the back thereof.

Figure 1:
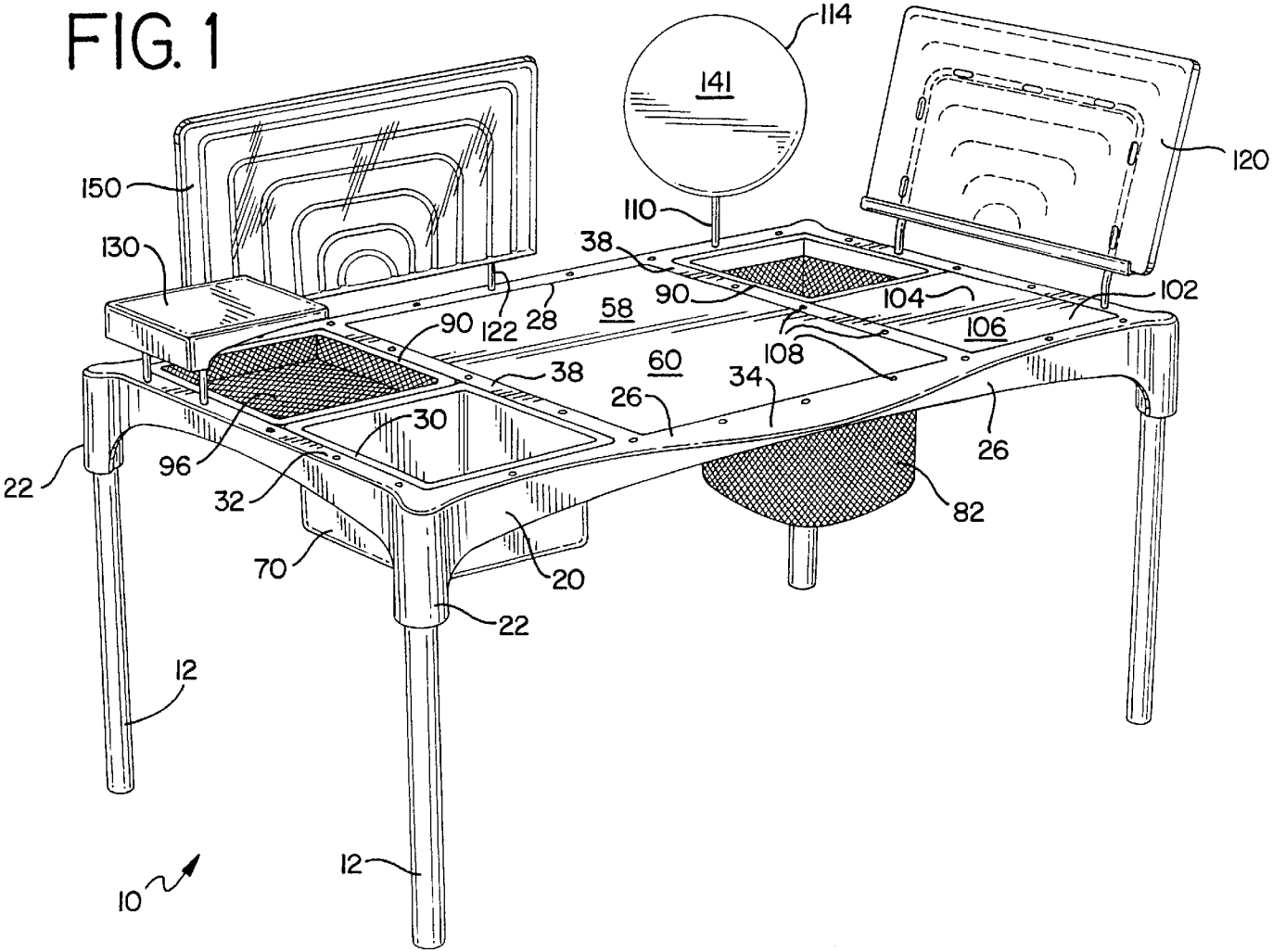
FIG. 1 is a perspective view of a modular desk workspace.
Figure 2:
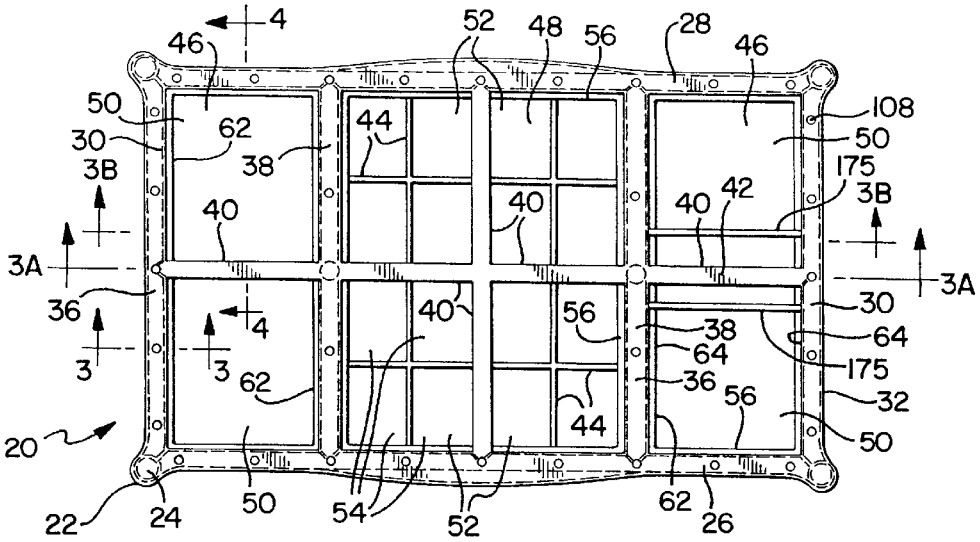
FIG. 2 is a top view of a worksurface frame.

Referring to the drawings and as best shown in FIG. 1, a preferred embodiment of a modular desk 10 includes a worksurface frame 20 and a plurality of support legs 12, shown in the Figures as four support legs. The support legs are preferably made of metal, e.g., steel, although other materials such as plastic, fiberglass, and wood would also work. The frame, which is preferably molded, preferably is made of structural foam comprised of 40% glass-filled polypropylene, although it should be understand that other materials including molded plastics, wood or metal would also work. The frame 20 is preferably substantially rectangular and includes four downwardly opening sockets 22 located at the comers thereof. An end of one of the support legs 12 is inserted into each socket 22. Each socket 22 is preferably configured as a star shape, or with four radially extending key holes or slots 24. The end of the leg is inserted into the socket 22 with an interference fit, with the end of the leg engaging the star-shaped socket such that the ribs are plastically deformed and assumes the shape of the leg. This interference fit eliminates the need for other fasteners, such as mechanical fasteners and the like. It should be understood that the frame can be formed in other shapes, including a round, oval, triangular, and diamond shape, and can be supported by one or more support legs, including for example a single pedestal leg. Likewise, the socket can be formed in any number of shapes, including a round, rectangular or triangular opening, with the leg having an end portion shaped to be received therein. The leg can be secured in the socket with a friction fit or with other fasteners, including for example adhesive and/or mechanical fasteners.

Referring to FIGS. 1–6, the frame includes a laterally extending front and back primary frame member 26, 38 and a pair of longitudinally extending side primary frame members 30 joined at the ends thereof respectively. The front, back and side frame members define a periphery 32 of a worksurface area of the desk.

A "worksurface" preferably comprises a planar, and preferably horizontal, surface or surfaces accessible to a user for supporting objects thereon, such as papers and the like, or a series of such planer surfaces vertically and/or horizontally displaced relative to each other. A "work surface area" is the total area circumscribed by the outer periphery of a worksurface, or a plurality of worksurfaces, and includes the area or areas within such total area that is occupied by voids or openings formed therein.

The front and back frame members each have a longitudinally extending curved portion 34 that extends outwardly, forwardly and backwardly from the frame members. The upper surface 36 of the primary frame members is exposed to the user and preferably forms a portion of the worksurface and define a portion of the worksurface area. The frame 20 further includes a pair of longitudinally extending interior primary frame members 38 that are formed substantially parallel to the side frame members 30 and connect the front and back frame members 26, 28. The upper surfaces of the interior primary frame members 38 also preferably form a portion of the worksurface and define a portion of the worksurface area.

Interior secondary frame members 40 extend laterally and longitudinally between the front and back primary frame members 26, 28 and between the side primary frame members 30 and the interior primary frame members substantially at the midpoints thereof. The secondary frame members 40 have an upper surface 42 spaced apart from and disposed below the upper surface 36 of the primary frame members, which form a portion of the worksurface. In addition, a plurality of stiffeners 44 extend between the longitudinally extending primary and secondary interior frame members 30, 38, 40 and between the secondary interior frame member 40 and the front and back frame members 26, 28. The stiffeners 44 also preferably have an upper surface 42 spaced from and disposed below the worksurface.

The primary frame members 26, 28, 30, 38 define a middle region and opposite side regions of the work surface area, all of which extend longitudinally between the front and back edge of the worksurface. The primary frame members 26, 28, 30, 38 further define a middle 48 and two side openings 46 therebetween in the middle and side regions respectively, with the openings extending longitudinally between the front and back frame members 26, 28. The secondary frame members 40 further divide the side openings 46 and thereby define a pair of longitudinally spaced side openings 50 in each of the side regions between the side frame members 30 and the primary interior frame members 38. The secondary frame members 40 further divide the middle opening into a quadrant of four openings 52, with the stiffeners further dividing each of the openings 52 into a subquadrant of four more openings 54, so as to form a total of sixteen openings 54 between the front and back frame members 26 28 and the primary interior frame members 38 in the middle region of the worksurface area.

Figure 3:
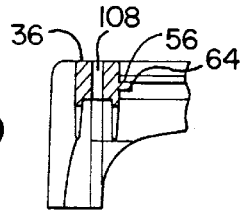
FIG. 3 is a cross-sectional view of the worksurface frame taken along line 3—3 of FIG. 2.
Figure 4:
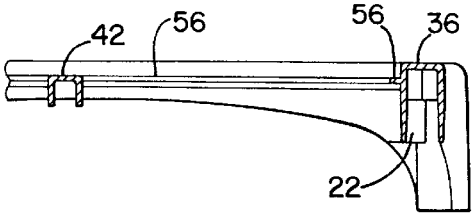
FIG. 4 is a cross-sectional view of the worksurface frame taken along line 4—4 of FIG. 2.
Figure 5:
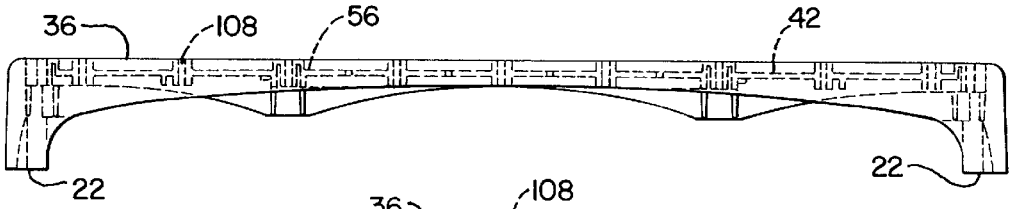
FIG. 5 is a front view of the worksurface frame.
Figure 6:
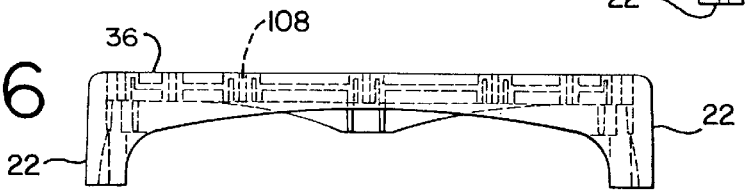
FIG. 6 is a side view of the worksurface frame.

As best shown in FIGS. 3 and 4, each of the primary frame members 26, 28, 30, 38 includes a recessed rim spaced below the upper surface 36 of the frame member. The rim 56 forms a ledge, or shoulder around the inner periphery of the openings 46, 48. In addition, the rim 62, which runs longitudinally along the side frame members 30 and the opposing side of the primary interior frame members 38, preferably includes an upwardly extending lip portion 64. The rim 62 is spaced slightly below the rim 56 with the top of the lip portion 58 being in substantially the same plane as the rim 56.

Referring to FIG. 1, a worksurface member 58 is disposed in the recess formed by the rim 56 on the front, back and primary interior frame members, and covers the middle opening 48 defined thereby. The worksurface member 58 is supported by the upper surface 42 of the secondary interior frame members 40 running between the front and back frame members and between the primary interior frame members, by the upper surface 42 of the stiffeners 44 and by the rim 56 formed around the periphery of the primary frame members 26, 28, 38 in the middle region. The worksurface member has an upper surface 60 that is preferably flush with the upper surface 36 of the primary frame members 26, 28, 30, 38, that forms in part the worksurface and the defines in part the worksurface area. The worksurface member 58 preferably is retained within the recess with adhesive and/or fasteners, including for example mechanical fasteners and/or Velcro, although it should be understood that the worksurface member could be removeably, loosely disposed in the recess without any such additional mounting. It also should be understood that the stiffeners 44 and one or more of the secondary frame members 40 could be omitted to form larger openings, or to expose the single opening 50.

Figure 24:
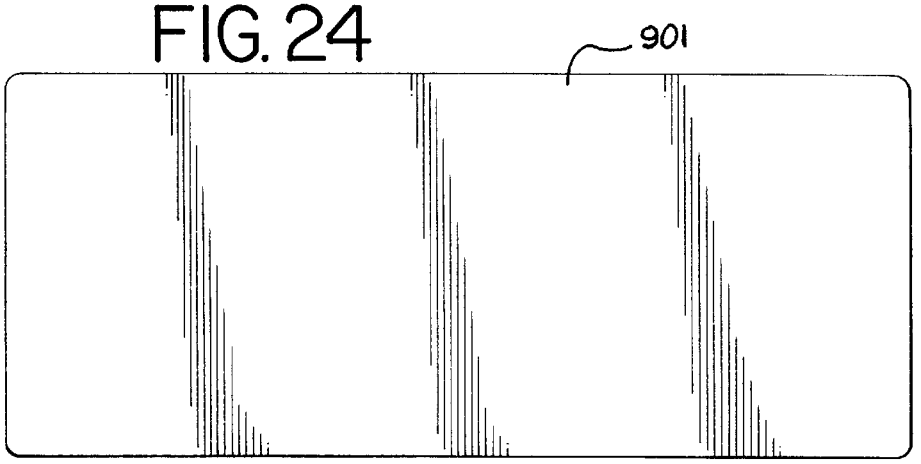
FIG. 24 is a plan view of a side worksurface member.

It should also be understood that a side worksurface member 901, shown in FIG. 24, also can be disposed in the recess formed by the side, front, back and primary interior frame members that define the side openings 46 or 50 to thereby cover such openings 46 or 50 and further form in part the worksurface. The side worksurface member is preferably made of light weight industrial insulating board with an upper and lower HPL surface layer applied thereto. Preferably, the side worksurface member has a first and second side that are configured with different colors or other indicia, such as various patterns, including for example, geometric patterns and patterns of different colors, dots, alphanumeric characters, checkerboard, stars, etc. The worksurface member 58 can likewise be configured with different colors or indicia on opposite sides thereof. In operation, one or more of the worksurface members 58, 901 can be flipped over so as to provide the desk with a different appearance.

Preferably, however, the middle region of the worksurface area is covered with a worksurface member, while the side regions are provided with openings to receive the various storage accessories, described below, such that the user is provided with more clearance under the desk in the middle region so as to facilitate the movement of the user's legs beneath the desk. The worksurface member 58 is preferably made of a ½ inch thick particle board with a HPL writing surface attached thereto, although it should be understood that other materials, including for example, plastic, metal, fiberglass, epoxy or wood, could be used.

Referring to FIG. 1, a variety of various storage accessories can be supported by the worksurface frame, both below and above the worksurface. It should be understood that the term "storage" means a space or place for storage, and is intended to broadly include flat surfaces for supporting various objects, and also surfaces such as tackable surfaces, marker boards, flip pads, chalkboards and the like, which store respectively various alphanumeric figures, notes and other items.

A first storage accessory is shown in FIGS. 1 and 11–13 as a storage tub 70. The storage tub 70 has a front and back rim 72 and side rims 74 that extend around the periphery of the tub. The rims 72 are received in the recess formed by the rim 56 of the primary frame members and the upper surface 42 of the secondary frame members, and engage the rim 56 and the upper surface 42 of the secondary frame members. The side rim 74, which extends down further than rim 72, rests on rim 62 and engages the lip portion 64. The body 78 of the tub which forms a basin, extends into one of the openings 50 formed by the primary and secondary frame members 26, 28, 30, 38, 40. The tub rims 72, 74 form a recess and act as handles that can be grasped by the user. The rims include a downwardly extending edge portion, or lip, that has a greater length along the sides of the tub, as explained above. The lip 76 is shaped to overlap with the upwardly extending lip 64 of the primary frame members. The tub is preferably molded from hard plastic, and more preferably from ABS plastic or other like polymers, and includes a pattern of stiffener ribs 80 formed on a bottom surface thereof, although it should be understood that the tube can be made out of other materials including various metals, epoxies, fiberglass, and wood. The tub can further be insulated to provide storage for and maintain the temperature of various food articles or beverages. The tub can also be provided with a drain plug. When vertically mounted in the worksurface frame, the tub is open at the top to provide access to the user to the items stored in the tub, which are disposed therein through the top thereof through the opening 50 in the worksurface area.

Figure 7:
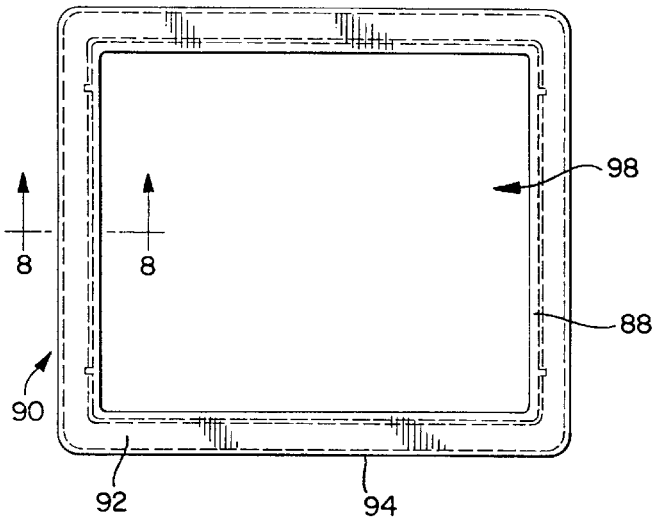
FIG. 7 is a top view of an accessory frame.
Figure 8:
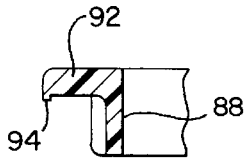
FIG. 8 is a partial cross-sectional view of the accessory frame taken along line 8—8 of FIG. 7.
Figure 14:
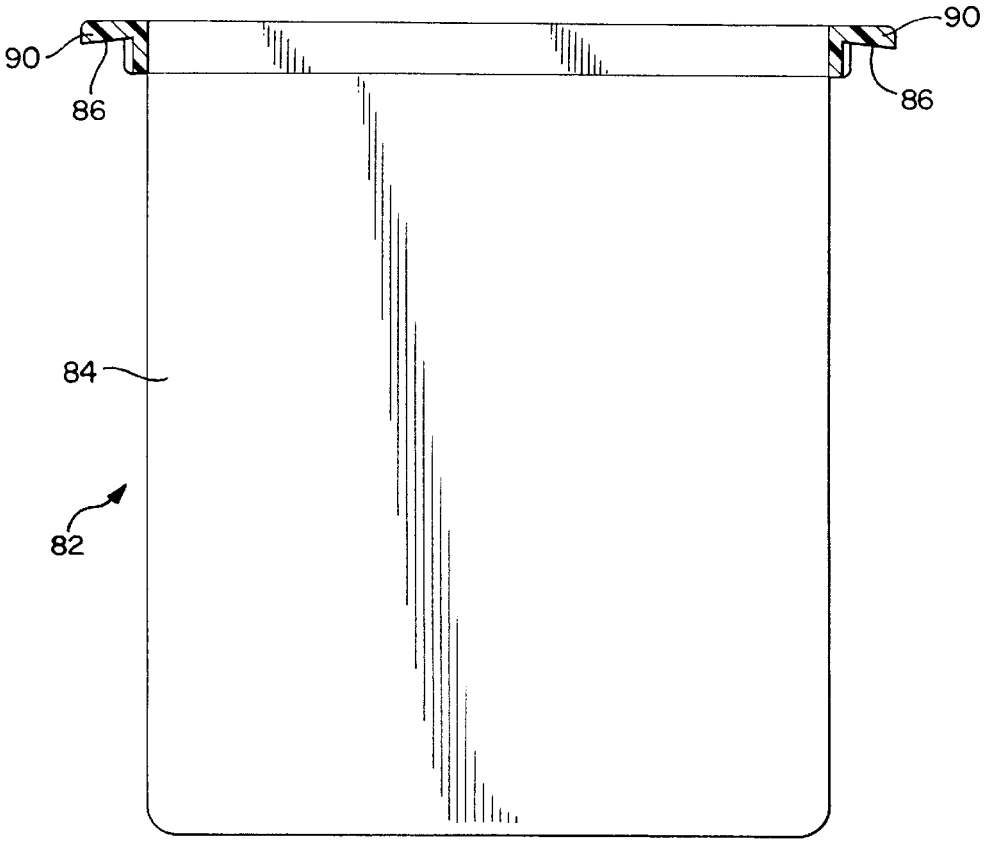
FIG. 14 is a cross-sectional view of a storage basket assembly.
Figure 15:
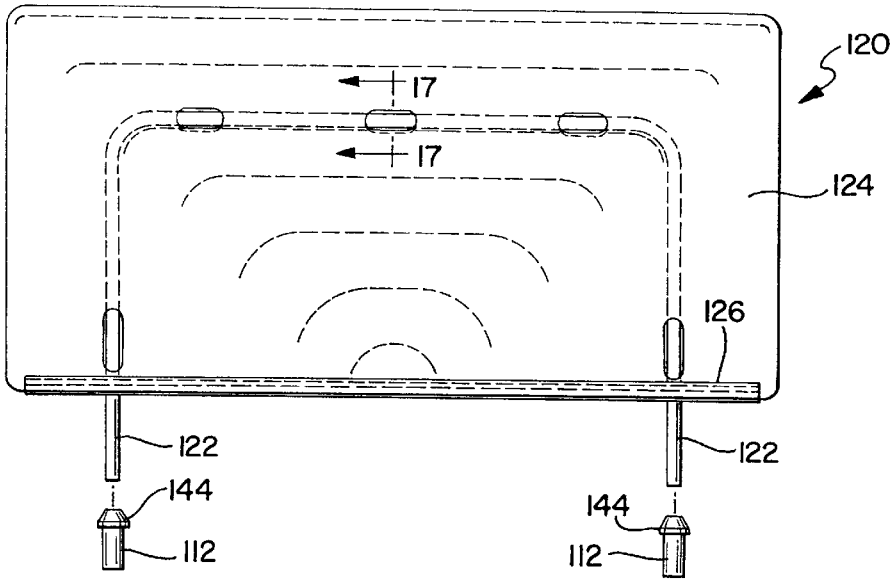
FIG. 15 is a front view of a document stand.
Figure 16:
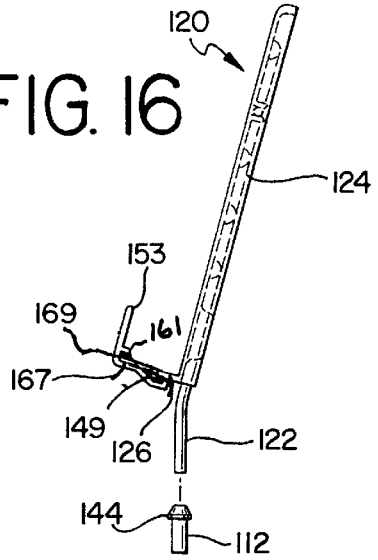
FIG. 16 is a side view of the document stand.

A second storage accessory is shown in FIGS. 1 and 14 as a basket assembly 82. The basket assembly preferably includes a support frame 90 and a basket 84, which is received in one of the openings 50 formed by the primary and secondary frame members. The basket 84 has a peripheral edge portion 86 that is wrapped around the support frame and is fastened to an underside thereof with fasteners, including for example, staples, adhesive or Velcro. One embodiment of the frame 90, shown in FIGS. 7 and 8, comprises an outwardly extending rim portion 92 that runs around the periphery of the frame. The rim portion 92 is received in the recess formed by the rim 56 of the primary frame members and engages the rim 56 and the upper surface 42 of the secondary frame members. The rim further includes a lip portion 94 formed on an underside thereof. The lip 94 forms a recess beneath the rim portion 92 so as to provide clearance for the various fasteners, e.g. staples, that secure the basket to the support frame. A vertical wall 88 extends downwardly from the rim to define an inner periphery of an opening 98. The basket can be used to store a variety of objects such as books and personal articles, and further can be used as a waste receptacle. The basket is preferably made of a flexible, pliable material, such as netting, although it should be understood that other flexible materials such as fabric or plastic would also work. The support frame is preferably made of a relatively rigid material, such as structural foam polypropylene.

Figure 3A:
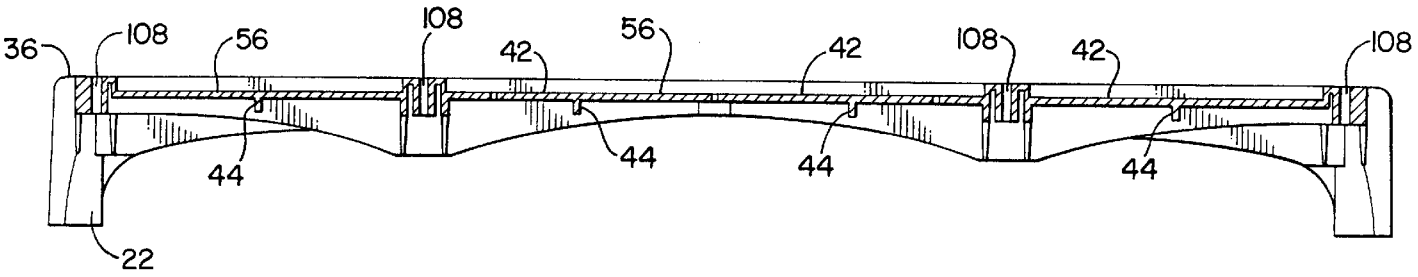
FIG. 3A is a cross-sectional view of the worksurface frame taken along line 3A—3A of FIG. 2.
Figure 3B:
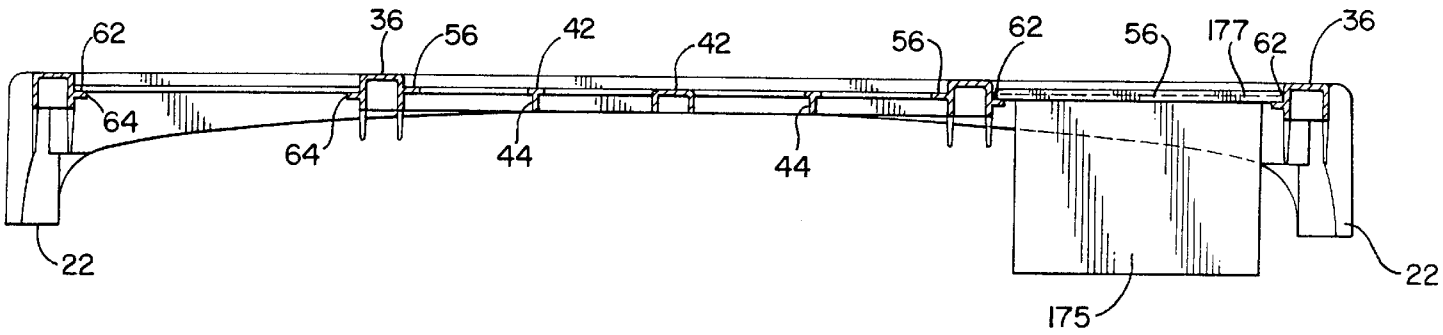
FIG. 3B is a cross-sectional view of the worksurface frame taken along tine 3B—3B of FIG. 2.

The rims 62, which run longitudinally along the side frame members 30 and the opposing sides of the primary interior frame members 38, are preferably laterally spaced so as to define runners that support an storage accessory, shown as a standard hanging file folder 175 in FIG. 3B. The file folder 175 includes a pair of hooks 177 formed on each end thereof that engage and slide on the upwardly extending lip portion 64 of the rims 62. As such, a plurality of file folders can be stored in the opening, and can be covered with a cover that provides a worksurface thereabove.

Figure 9:
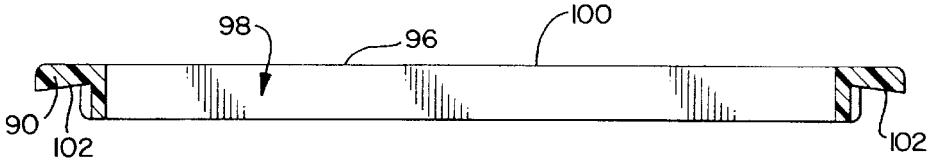
FIG. 9 is a cross-sectional view of a flexible membrane accessory.
Figure 11:
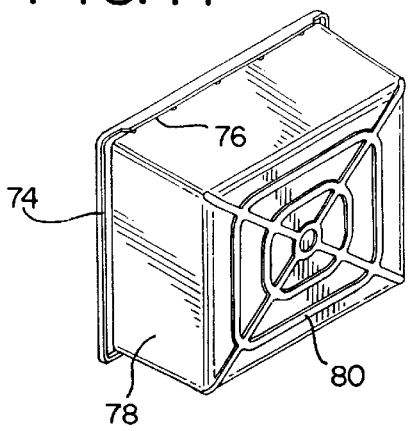
FIG. 11 is a bottom perspective view of a storage tub.
Figure 12:
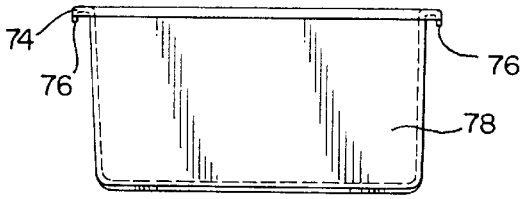
FIG. 12 is a front view of the storage tub.
Figure 13:
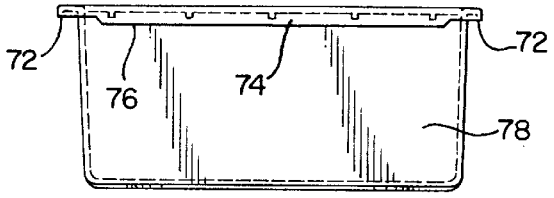
FIG. 13 is a side view of the storage tub.

Referring to FIG. 9, a storage accessory is shown as comprising a resilient, flexible membrane worksurface accessory. The term resilient means capable of withstanding shock without permanent deformation or rupture. The term flexible means pliant, or capable of being deflected or deformed. The worksurface accessory includes a resilient, flexible membrane 96 that is stretched across the opening 98 formed by the frame member 90 to form a resilient worksurface member. The membrane 96 is preferably made of a woven elastic material, and more preferably is made of LYCRA, although it should be understood that a rubber mat or other flexible, resilient material or fabric, preferably including elastic or elastomeric elements, threads or filaments, would also work. In this way, the membrane is preferably made of a "stretchable" material, meaning a material that can be extended in length, breadth or both, and which is capable of recovering or resuming its original size and shape after being deformed.

Preferably, an upper surface 100 of the flexible membrane defines a worksurface that is substantially flush with, or is positioned slightly below, and forms in part, the worksurface of the desk, which also preferably includes the worksurface 60 of the worksurface member 58 and the upper surface 36 of the primary frame members, all of which define in part the worksurface area. The peripheral edges 102 of the membrane are preferably wrapped around the support frame member 90 and attached to an underside thereof, as described above with respect to the basket. In this way, the entire periphery of the membrane 96 is preferably fixedly, non-movably and directly attached to a support structure, such as the support frame 90, without any intervening springs or other devices capable of further deflection. It should be understood that other attachment devices, used to attach the periphery of the membrane to the support frame, such as adhesive and in-molding can also be used.

The flexible membrane provides an ideal location to dispose various fragile articles, such as eye glasses and the like. Indeed, the preferably stretched, flexible membrane will flex, or temporarily deform or deflect, when such items are tossed onto the membrane, otherwise referred to as a touch pad, so as to protect such articles from inadvertent damage. Preferably, the worksurface area of the membrane 96 preferably occupies or defines only a portion of the total worksurface area defined by the frame, and more preferably less than 50% of such an area. In a preferred embodiment, the worksurface of the flexible, resilient membrane is positioned immediately adjacent to a non-resilient or rigid worksurface, which can be comprised, for example, of the upper surface 36 of the primary frame members and/or the upper surface 60 of the worksurface member 58.

Figure 23:
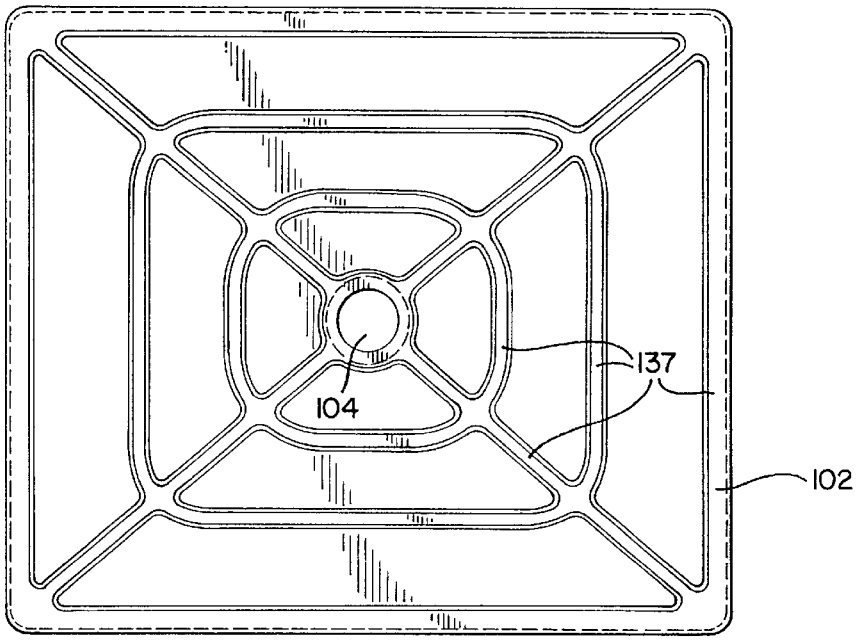
FIG. 23 is a bottom view of a cover.

As shown in FIGS. 1 and 23, a cover 102 can be disposed over any of the openings, or over the top of any of the afore-mentioned storage accessories disposed in one or more of the openings. The cover 102, or worksurface member, has an upper surface 106 that defines a worksurface, and is preferably substantially flush with the upper surface 60 of worksurface member 58 and the upper surface 36 of the primary frame members. When disposed over the basket assembly 82 or the flexible worksurface accessory, the upper surface 106 may be slightly raised above the upper surfaces 36, 60. Conversely, when the cover 102 is positioned over an opening without any accessory disposed therein, the upper surface 106 may be slightly lower than the upper surfaces 36, 60. The cover preferably has a hole 104 formed therein such that a user can insert one or more fingers to grasp the cover for removal and replacement. The bottom of the cover, which is preferably molded, includes a pattern of stiffeners 137. The cover is preferably made of ABS plastic, but can be made of other preferably non-resilient materials, including for example wood, fiberglass, epoxy or metal. When two covers 102 are placed over the openings 50 in one of the side regions, the mating edges of the covers are substantially abutted, with preferably only a small gap formed therebetween for tolerances.

It should be understood that any of the aforementioned storage accessories, including the covers, can provide in different colors, which can function as indicia to indicate to the user the type or identify of the accessory, or to indicate the type of goods or articles stored therein or thereon. For example, a particular color can be assigned to a particular storage accessory to aid the user in organizing their workspace, or for identifying for others where a particular type of accessory or stored article is located. For example, the user can designate that waste products will be retained in a black basket, and/or that office supplies will be retained in a red tub. The user also can arrange the various storage accessories, with their various associated colors, to suit their aesthetic needs.

Moreover, since each of the covers and storage accessories are preferably completely removable, meaning that they can be entirely disconnected from the table, the workspace and desk can be easily reconfigured simply be removing one or more of the accessories and replacing it with one or more other accessories. For example, if a particular workspace will be used by a plurality of users, a first user can tote their personal articles in a storage accessory and dispose the accessory in the frame during the time period they are working at the desk. At the end of that time, the user can take their storage accessory with them. In addition, a workspace can be configured with a plurality of various storage accessories arranged or rearranged as desired by a particular user.

The various storage accessories are preferably disposed in openings formed in the preferably horizontal worksurface area on each side of the central worksurface member 58 in the side regions, as explained above, so as to provide maximum leg clearance beneath the worksurface member 58. However, it should be understood that the middle opening 48, or openings 52 could also provide space for various storage accessories to be received therein. In such an embodiment, which preferably omits the stiffeners, the worksurface member would be removed, and various storage accessories would be received in the openings, with the rim or edge of the accessory engaging the rim of the primary frame members and the upper surface of the secondary frame members.

The desk also provides for arranging various storage accessories above the worksurface. In particular, and referring to FIGS. 1–6, a plurality of sockets 108 are formed in the upper surface of each of the primary frame members and are accessible from the top of the frame. The sockets 108 are preferably tapered and are in-molded into the frame during the molding process. Various storage accessories include one or more stanchions 110, shown in FIG. 10, which preferably have a tapered insert portion 112 attached to an end thereof. The insert portion 112 has a cylindrical interior bore that is shaped to receive the end of the stanchion leg, and an exterior tapered surface that is received in the socket 108 with a friction fit, with the stanchion extending upwardly from the worksurface. The stanchion leg is preferably formed from a rigid steel wire. The insert portion further includes a shoulder 144 formed as a circumferential lip around an upper portion of the insert portion. Of course, it should be understood that the end of the stanchion itself can function as an insert portion.

Figure 10:
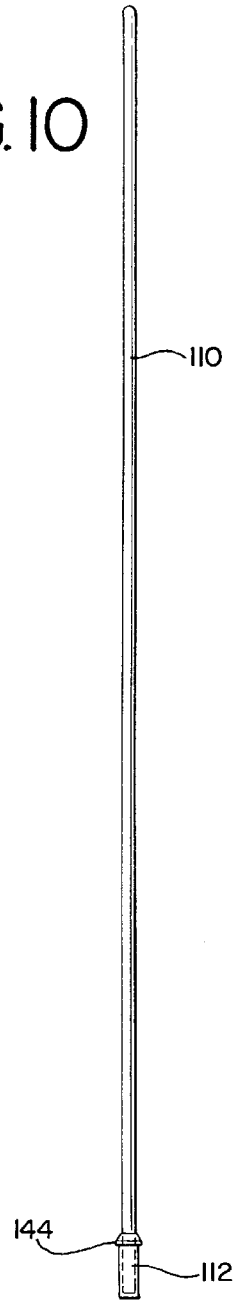
FIG. 10 is a side view of a stanchion.
Figure 21:
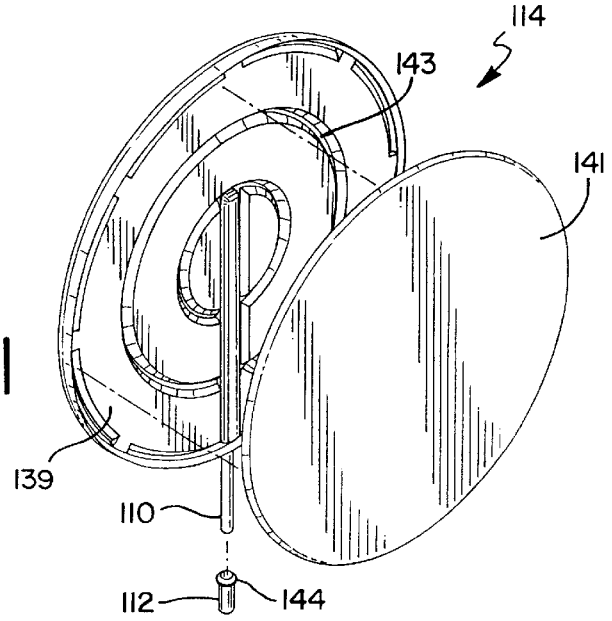
FIG. 21 is an exploded perspective view of a placard.
Figure 22:
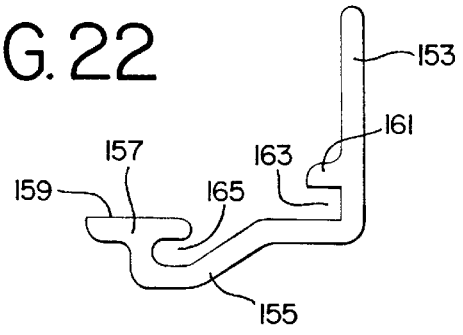
FIG. 22 is an end view of a lip member for the document stand shown in FIGS. 15–17.

Referring to FIGS. 1 and 21, a placard 114, configured as a circular marker board, is shown as being attached to a vertically extending signpost stanchion. In particular, the stanchion 110, shown in FIG. 10, is inserted into, or in-molded with, a molded polyester mat 139, which forms one side or layer of the placard. Alternatively, the stanchion can be bonded to the mat. The mat preferably has a pattern of stiffener ribs 143 molded therein. The other side, or layer, of the placard is preferably a marker board 141, which is bonded to the mat 139. Other placard accessories such as nameplates, note pads and the like can be attached to the sign post stanchion. Similarly, various light fixtures can be fastened to the stanchion.

Referring to FIGS. 1, 15–17 and 22, a document stand 120 is shown as including a U-shaped stanchion 122 having a pair of insert portions 112 disposed on each end thereof. The document stand includes a back support panel 124 angled slightly from the vertical plane, and a bottom support panel 126 extending laterally from the back panel 124. A hook, or lip portion 149 extends rearwardly from a bottom surface of the support panel 126. A retainer member 151 includes a front wall 153 and a base wall 155 having a curved section terminating in a support platform 157. A lip 161 extends laterally from the front wall 153 to form a groove 163 or channel that extends along the length of the retainer member. The support platform 157 and bottom or base wall 155 form a groove 165 or channel therebetween that also runs along the length of the retainer member. When installed, a front edge 169 of the support panel 126 is received in the channel 163, while the hook 149 is received in the channel 165, with an upper surface 159 of the support platform 157 engaging a bottom surface 167 of the support panel to react against any moment caused by a force applied against the front wall of the retainer 151. In this way, the retainer can be easily removed or attached to provide an additional support for various documents and the like as needed.

Figure 17:
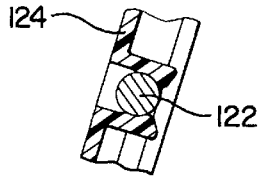
FIG. 17 is a cross-sectional view of the document stand taken along line 17—17 of FIG. 15.

The back panel 124 is attached to the stanchion 122 with tabs 128 in a snap-fit engagement, as shown in FIG. 17, although it could also be in-molded therewith or bonded thereto. The bottom panel 126 is configured to support various documents and the like as they are leaned against and/or supported by the back panel. When installed, the insert portions 112 of the U-shaped stanchion 122 are mounted in a pair of sockets 108 formed in the worksurface frame.

Figure 20:
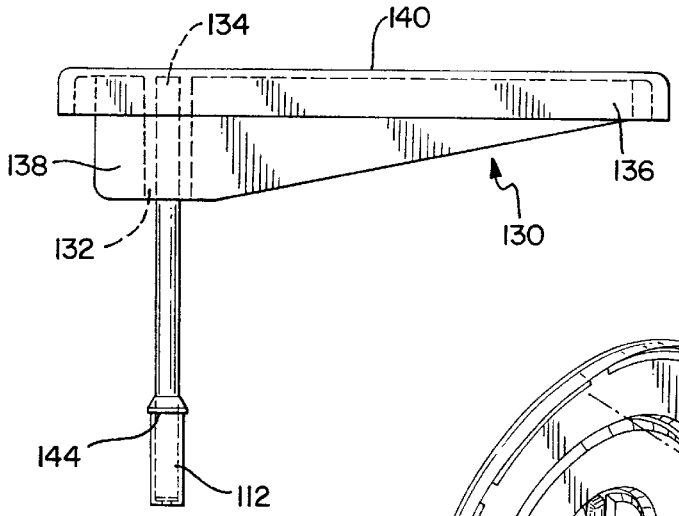
FIG. 20 is a shelf.

Referring to FIGS. 1 and 20, a shelf 130 is shown as including a stanchion support 138 having a pair of sockets that are shaped to receive an end of a stanchion 134. The shelf includes a platform 136 that is cantilevered away from the stanchion support 138. The platform 136 defines a support surface 140 for supporting various pieces of office equipment such as telephones, computers, calculators and the like. The shelf 130 allows the user to support such equipment above the primary worksurface, so as to free the worksurface for the user. When installed, the insert portions 112 of the pair of stanchions are mounted in a pair of sockets formed in the worksurface frame, with the shoulder 144, or circumferential lip, limiting the depth of insertion therein.

Figure 18:
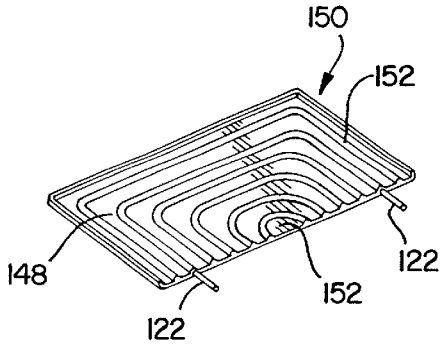
FIG. 18 is a perspective view of a screen.
Figure 19:
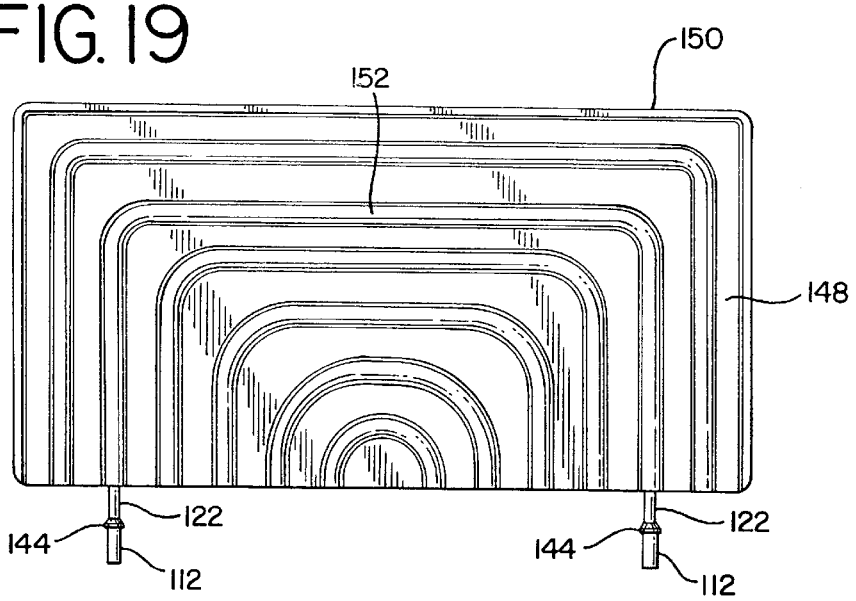
FIG. 19 is a bottom view of the screen.

Referring to FIGS. 1 and 18–19, a privacy screen 150 is shown as including a plurality of generally U-shaped stiffener rib portions 152. A U-shaped stanchion 122, which provides additional stiffness and strength, is inserted into, or in-molded with, the screen. Alternatively, the stanchion can be bonded or adhered to the mat. The screen is preferably made of compressed polyester fibers, which are preferably formed into a non-woven mat 148 or blanket.

In particular, the mat 158 is made of a moldable material, which preferably comprises a blend of component materials, at least one of which is a thermoplastic, including but not limited to polyester, co-polyester, polypropylene, nylon, or blends thereof, for example. Another of the component materials may have a slightly higher melting point, providing a matrix to which lower melting point materials may bond. The higher melting point materials may also include thermoplastics such as polyesters, polypropylene, and nylon for example, or may include natural materials such as sisal, cotton, flax and hemp, for example. In one embodiment, the use of an all-polyester composition, for example, may provide a freer flowing base material that will conform to tighter radius mold shapes. The mat is preferably provided as a non-woven mat. Re-cycled or virgin polyester and polypropylene may be chopped, shredded, carded, blended and lofted into a non-woven sheet and rolled into a roll. For example, a homogenous mixture of polyester and polypropylene may be blended.

In an alternative embodiment, the screen comprises a first mat of moldable material and a second mat, or stratum, of filler material, which comprises a filler embedded into a mat of moldable material. In this way, a second mat of a homogeneous mixture of moldable material and filler material is provided. The filler materials may include any of various materials that preferably have a melting point temperature that is higher than that of the moldable material. Exemplary materials include, without limitation, polyester, polypropylene, fiberglass, nylon, ceramics, metals, sisal, cotton, flax and hemp, for example.

The mat of moldable material, or a combination of a first and second mat of moldable and filler materials respectively, are preferably heated in an oven to a point of transition from the solid state to the liquid state of the material. Some of the fibers of the moldable material may liquefy in the oven while others remain solid, and yet others may be in a transition or gel-like condition. Thus, the material becomes very soft and can still be handled because it retains enough of the mat structure. The hot mat, or mats, is conveyed from the oven to a bonding press, which includes a pair of mold halves. The hot moldable material may fully transition to the liquid material state in the mold because of the pressures applied by a press to the mold halves. Regardless, the hot moldable material flows in the mold because of the pressure. If two mats are used, the mats become a single layer comprising a moldable material with a stratum of filler material embedded therein. The molten moldable material flows throughout the mold cavity and attaches to the non-molten material. The mold halves, which form the cavity, are temperature controlled below the melting point of the moldable material. Thus, the oven heats the moldable material and the pressure of the closed mold in the press shapes the material before the transfer of heat from the material to the die sets the material in the solid state.

Structural characteristics of the resulting molded mat, or screen, are controlled by adjustment of the material make up, the material density and the mold pressure. For example, for a given amount of material, a given mold cavity volume will result in a particular material density. The moldable material will commonly be viscous and will not flow freely, running throughout the mold cavity. Rather, the moldable material will tend to remain at the location where it was placed when the press closes the mold. Thus, the mat may have localized areas of relatively higher material density, and associated greater material toughness, where the mold cavity and the resulting mat cross-sectional thickness is thinner.

By holding the mold cavity volume constant, an increase in the amount of material will increase the resulting material density. As will be understood by those of skill in the art, a mat having a greater density will have a greater resistance to puncture. In any event, however, the resulting mat, which can be molded into a great number of various shapes, will have excellent structural rigidity while at the same time providing an ideal tackable material. In addition, the color of the mat can be controlled by introducing various dyes into the mix of materials. In this way, the mat of molded compressed fibers can provide improved aesthetics without the need for additional coverings or surface laminates. Moreover, the compressed fibers can be easily molded into a variety of two-dimensional and three-dimensional shapes, which can include for example various stiffener ribs and the like, and provide their own structural support without the need for additional support members.

Preferably, the opposite sides of the molded mat, and in particular, the moldable material, are left exposed to the end user. In this way, at least a portion of the moldable material, e.g. the polyester fibers, which is preferably dyed, is exposed and visible to the user. This construction avoids the need for an additional facade material, such as a fabric, being applied to one or more of the opposite sides, which can add to the expense and difficulty of manufacturing the mat.

The molding process, and the various materials used therein, are also disclosed in U.S. Provisional Application No. 60/167,303 entitled "Partitional Panel Insert Panel," filed Nov. 24, 1999, in the name of Kenneth Assink, the entire disclosure of which is hereby incorporated herein by reference.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A modular desk comprising:

a frame having an upper surface and defining a periphery of a worksurface area, said frame further dividing said worksurface area into opposite side regions and a middle region positioned between said side regions, each of said side regions having at least one opening formed within said worksurface area;

a worksurface member supported by said frame in said middle region, wherein said worksurface member comprises an upper surface defining a worksurface, and wherein said upper surface of said frame lies substantially flush with said upper surface of said worksurface member;

a storage accessory removably received in one of said openings, wherein said storage accessory releasably engages said frame; and a cover disposed over said storage accessory, wherein said cover comprises an upper surface defining a worksurface.

2. The invention of claim 1 wherein said frame defines at least two openings formed within each of said side regions, and wherein a plurality of storage accessories are removeably received in said openings, wherein each of said storage accessories releasably engages said frame.

3. The invention of claim 2 wherein said plurality of storage accessories are different colors.

4. The invention of claim 1 wherein said frame comprises a recessed lip formed around at least a portion of a periphery of at least one of said openings, and wherein said at least one storage accessory comprises an edge portion engaging said recessed lip.

5. The invention of claim 1 wherein said cover has an opening formed therein, wherein said opening in said cover is shaped to permit a user to grasp the cover.

6. The invention of claim 1 wherein said storage accessory comprises a tub.

7. The invention of claim 1 wherein said storage accessory comprises a basket.

8. The invention of claim 1 wherein said storage accessory comprises a flexible membrane stretched across said opening.

9. The invention of claim 1 wherein said frame further comprises a plurality of sockets formed in said frame member, and further comprising a second storage accessory comprising at least one stanchion, wherein said at least one stanchion comprises an insert portion shaped to be received in at least one of said plurality of sockets.

10. The invention of claim 9 wherein said sockets are formed around at least a portion of the periphery of said worksurface area.

11. The invention of claim 9 wherein said sockets are tapered.

12. The invention of claim 9 wherein said frame is molded and wherein said sockets are in-molded in said frame.

13. The invention of claim 9 wherein said second storage accessory comprises a screen.

14. The invention of claim 9 wherein said second storage accessory comprises a post member and a placard connected to said post member.

15. The invention of claim 9 wherein said secondary accessory comprises a support stand.

16. The invention of claim 15 wherein said support stand comprises a substantially horizontal support surface.

17. The invention of claim 1 wherein an uppermost surface of said storage accessory is disposed substantially flush with or below said upper surface of said frame.

* * * * *